US010412819B2

(12) United States Patent
Wang

(10) Patent No.: US 10,412,819 B2
(45) Date of Patent: Sep. 10, 2019

(54) PLASMA HEATER

(71) Applicant: QILU UNIVERSITY OF TECHNOLOGY, Jinan, Shandong (CN)

(72) Inventor: Shouguo Wang, Beijing (CN)

(73) Assignee: QILU UNIVERSITY OF TECHNOLOGY, Jinan (CN)

( * ) Notice: Subject to any disclaimer, the term of this patent is extended or adjusted under 35 U.S.C. 154(b) by 0 days.

(21) Appl. No.: 16/104,141

(22) Filed: Aug. 17, 2018

(65) Prior Publication Data

US 2019/0059147 A1 Feb. 21, 2019

Related U.S. Application Data

(63) Continuation of application No. PCT/CN2016/000084, filed on Feb. 17, 2016.

(51) Int. Cl.
*H05H 1/28* (2006.01)
*F24H 1/00* (2006.01)
(Continued)

(52) U.S. Cl.
CPC ..... *H05H 1/28* (2013.01); *F24D 15/00* (2013.01); *F24H 1/00* (2013.01); *H05B 7/185* (2013.01);
(Continued)

(58) Field of Classification Search
CPC ... H05B 1/34; H05B 1/28; H05B 1/26; H05B 1/30; H05B 1/32; H05B 1/3405; H05B 1/341; H05B 1/36; H05B 1/43; H05H 2001/3426; H05H 2001/3431; H05H 2001/3436; H05H 2001/3442;
(Continued)

(56) References Cited

U.S. PATENT DOCUMENTS 2,488,807 A * 11/1949 Currie ..... F28F 9/0241 165/159
3,934,554 A * 1/1976 Carlson ..... F22B 7/06 122/176
(Continued)

FOREIGN PATENT DOCUMENTS

| | | | |
|---|---|---|---|
| CN | 102625558 | A | 8/2012 |
| CN | 104717818 | A | 6/2015 |
| CN | 105066419 | A | 11/2015 |
| JP | 2001118838 | A | 4/2001 |
| KR | 20110032551 | A | 3/2011 |

(Continued)

*Primary Examiner* — Tu B Hoang
*Assistant Examiner* — Masahiko Muranami
(74) *Attorney, Agent, or Firm* — Wayne & Ken, LLC; Tony Hom

(57) ABSTRACT

A plasma heater includes a plasma heating section, an exhaust wasteheat heating section, a gas circulation pump, a water cooling system, and a treatment tank for waste gas and waste water. Flames emitted by plasma torches of plasma generators are directly sprayed onto first water pipes for heating. Exhaust generated after combustion of the plasma torches flows through the tail gas residual heat heating section in the metal cylindrical casing, then flows out of the metal cylindrical casing to enter the gas circulation pump, and flows back into the plasma generators through the gas circulation pump for recycling. After the circulating exhaust operates for more than 10 minutes, the discharged waste gas and waste liquid enter the recovering treatment tank.

10 Claims, 2 Drawing Sheets

(51) Int. Cl.

| | |
|---|---|
| ***H05H 1/00*** | (2006.01) |
| ***F24D 15/00*** | (2006.01) |
| ***H05B 7/18*** | (2006.01) |
| ***H05H 1/34*** | (2006.01) |
| ***H05H 1/44*** | (2006.01) |

(52) U.S. Cl.

CPC ..... *H05H 1/00* (2013.01); *H05H 1/34* (2013.01); *H05H 1/44* (2013.01); *H05H 2001/3478* (2013.01); *H05H 2245/121* (2013.01)

(58) Field of Classification Search

CPC ... H05H 2001/3457; H05H 2001/3468; H05H 2001/3473; H05H 2001/3478; H05H 2001/3489; H05H 2001/3494

USPC ..... 219/121.48, 121.49, 121.36, 121.52, 219/121.51, 121.59, 121.5, 121.55; 373/18, 19, 22, 24, 68, 69, 71, 74, 75, 77, 373/78, 88, 90, 93, 94, 101, 102, 108

See application file for complete search history.

(56) References Cited

U.S. PATENT DOCUMENTS

| | | | | |
|---|---|---|---|---|
| 3,980,467 | A * | 9/1976 | Camacho | C21D 9/663 75/10.19 |
| 5,247,152 | A * | 9/1993 | Blankenship | H05H 1/28 219/121.48 |
| 5,685,997 | A * | 11/1997 | LoPresti | F22B 1/281 219/121.59 |
| 7,438,869 | B1 * | 10/2008 | Fabian | B01D 53/32 422/168 |
| 2011/0024397 | A1 * | 2/2011 | Lin | H05H 1/3405 219/121.5 |
| 2011/0032551 | A1 | 2/2011 | Faber et al. | |
| 2011/0284437 | A1 * | 11/2011 | Johnson | C02F 1/4608 210/150 |
| 2013/0121671 | A1 * | 5/2013 | Lee | F24H 1/0018 392/465 |

FOREIGN PATENT DOCUMENTS

| | | | |
|---|---|---|---|
| WO | 2010151026 | A | 12/2010 |
| WO | 2017117690 | A1 | 7/2017 |

* cited by examiner

PLASMA HEATER

CROSS-REFERENCE TO RELATED APPLICATIONS

This application is a continuation of International Application No. PCT/CN2016/000084 with a filing date of Feb. 17, 2016, designating the United States, now pending. The content of the aforementioned applications, including any intervening amendments thereto, are incorporated herein by reference.

TECHNICAL FIELD

The present invention relates to the technical field of heaters, and particularly to a plasma heater.

BACKGROUND

Boiler steam is adopted for traditional heating, and a heat exchanger is used to heat and circulate hot water. This traditional way of heating is energy-intensive, costly and needs a huge network of pipes.

The heater of electric heating tube seen in the past is heated by putting the heating tube in water. This way of heating is difficult to popularize due to low energy conversion efficiency and high operation cost.

Atmospheric thermal plasma technologies have been widely applied in recent years, and for example, for plasma cutting, plasma cladding, plasma propulsion and plasma assisted combustion for power plant ignition.

Korean patent with the patent No. of PCT/KR2010/004032 2010 Jun. 22 discloses mixed combustion of combustible water and waste oil. Although plasma is adopted for heating and assisting combustion, the plasma adopts argon as working gas, which is high in operation cost. Fossil fuel is used for combustion in a furnace, which inevitably produces exhaust emissions and further treatment is needed for exhaust.

Korean patent with the patent No. of 1020110032551 discloses a structure that uses a plasma torch to heat a spiral water pipe. The heating efficiency of plasma of the structure is relatively low as a lot of heat escapes into ambient space, and the exhaust inevitably brings environmental pollution.

American patent with the patent No. of 1020110032551 discloses a manner of heating water through vibration and radiant energy of photons and through multiple reflections of the photons in plasma by a reflecting mirror. This way of heating is low in efficiency and difficult to produce large-capacity boilers.

The patent with the patent No. of PCT/CN2016/000004 discloses a plasma boiler with closed cycle ionization combustion of exhaust. The boiler is a pressure container with high design and processing requirements, and is not suitable for heating.

SUMMARY

To solve the above technical problems, the present disclosure provides a plasma heater, a plasma heating section, an exhaust wasteheat heating section, a gas circulation pump, a water cooling system, a treatment tank for waste gas and waste water, and a plurality of circulating water pipes. And two of the plurality of circulating water pipes are communicated through a plurality of first water pipes and a diameter of each of plurality of the first water pipes is smaller than a diameter of each of the plurality of circulating water pipes. The plasma heater further includes a metal cylindrical casing, wherein the metal cylindrical casing is coated outside the plurality of first water pipes. The plasma heater further includes a plurality of plasma generators, wherein the plurality of plasma generators are mutually communicated and are provided on a bottom of the metal cylindrical casing and a flame emitted by a plasma torch of the plasma generator is directly sprayed onto the first water pipes for heating. The exhaust wasteheat heating section includes the metal cylindrical casing and the plurality of first water pipes. The plasma heating section includes the metal cylindrical casing, the plurality of first water pipes and the plurality of plasma generators. The water cooling system is connected to the plasma generators and power is supplied to the plurality of plasma generators by a plasma power supplier. The gas circulation pump is arranged on a water inlet end of the metal cylindrical casing and is communicated with the metal cylindrical casing and the treatment tank for waste gas and waste water. The exhaust generated after combustion of the plasma torch flows through the exhaust wasteheat heating section in the metal cylindrical casing, then flows out of the metal cylindrical casing and enters into the gas circulation pump, and flows back into the plasma generators through the gas circulation pump for recycling. The recycled exhaust works for more than 10 minutes before entering into the treatment tank for waste gas and waste water.

Further, the plurality of first water pipes are parallel mutually and have clearances mutually; and a diameter of the first water pipes is between 20 mm and 60 mm.

Further, a first connecting flange is arranged between the plasma generators and the bottom of the metal cylindrical casing on the plasma heating section. An insulation pad is arranged on the first connecting flange. The plasma generator is a DC plasma torch with an upward nozzle and a working gas of the plasma generators is a mixture of air and water vapor.

Further, the water cooling system includes a water cooling tank.

Further, a second connecting flange and a fourth connecting flange are arranged in the water inlet end and a water outlet end of the metal cylindrical casing, respectively. And a third connecting flange is arranged at a junction of the plasma heating section and the exhaust wasteheat heating section of the metal cylindrical casing.

Further, the circulating water pump is arranged in the water inlet end of the circulating water pipes Further, a fifth connecting flange is arranged in the water inlet and outlet ends of the circulating water pipes; and the insulation pad is arranged on the fifth connecting flange.

Further, a sixth connecting flange is arranged for exhaust emission between the metal cylindrical casing, the gas circulation pump and the treatment tank for waste gas and waste water.

Further, a circulating water pipe inlet is arranged in the water inlet end of the circulating water pipes and a circulating water pipe outlet is arranged in a water outlet end of the circulating water pipes.

Beneficial Effects:

The plasma heater of the present disclosure adopts a metal cylindrical casing provided with flanges on both ends to coat the first water pipes of circulating water. A certain clearance is set between the metal cylindrical casing and the first water pipes. And the plasma torches directly heat the bottoms of the water pipes. This manner of heating does not need an additional heating container or a heat exchanger. As the heater is not a pressure container, it is easy to manufacture, safe and reliable to operate. The first flange on the bottom of the metal cylindrical casing in the present disclosure is respectively connected with a plasma generator. The plasma generator is a DC plasma torch with an upward nozzle. This manner of heating adopting the plasma torch to directly heat the bottoms of the water pipes is high in heating efficiency.

The first water pipes coated by the metal cylindrical casing in the present disclosure have two sections. The first section is the plasma heating section, and the first section is the exhaust wasteheat heating section. The two sections are intercommunicated. This manner of adopting wasteheat of exhaust to directly heat the water pipes makes full use of wasteheat of exhaust.

The plurality of DC plasma torches included in the plasma heating section in the present disclosure are arranged in parallel on the bottom of the metal cylindrical casing for the convenience of disassembly and replacement. This design is also modular and convenient to install and maintain.

The plurality of first water pipes in the metal cylindrical casing of the present disclosure are first water pipes which are divided by the circulating water pipes and are parallel to each other at certain clearances. The outer diameter range of each first water pipe is between 20 mm and 60 mm. Compared with heating of a thick water pipe with larger diameter, the heating of the plurality of first water pipes increases heat exchange area. Therefore, heating efficiency is increased.

The exhaust generated by the plasma torches in the present disclosure flows through the exhaust wasteheat heating section in the metal cylindrical casing from the plasma heating section, then flows out of the metal cylindrical casing to enter an gas circulation pump of the exhaust, and flows back into the plasma generators through the gas circulation pump for recycling.

The exhaust generated by the plasma torches in the present disclosure is regularly discharged and updated after used for a period of time. Fresh air is introduced into the plasma torches for circular ionization combustion. Air change and discharge are completed within 1 minute, and the time interval between air change and discharge is more than 10 minutes. The purpose of introducing fresh air into the plasma torches for circular ionization combustion is to increase combustion reaction efficiency.

The plasma generators in the present disclosure are DC plasma torches, and working gas of the plasma generators is a mixture of air and vapor. So it is low in operation cost. Electrodes of the DC plasma torches shall be water-cooled by a cooling system which is formed by connecting the water cooling tank, the water pipes, a water level sensor and the water pump. The water cooling system is adopted to prolong the service life of the plasma generators.

The plasma generators in the present disclosure adopt the plurality of DC plasma torches with the same specification, thereby realizing modular combination and easy processing, installation and maintenance.

The exhaust of the plasma heater in the present disclosure is connected with the treatment tank for waste gas and waste water through a valve. After absorbed and purified by the treatment tank for waste gas and waste water, the exhaust is discharged out and waste liquid is recovered.

DESCRIPTION OF DRAWINGS

The present disclosure will be further described below with reference to the drawings.

LIST OF REFERENCE NUMERALS

100 plasma generator; 101 first connecting flange; 101 second connecting flange; 101B third connecting flange; 1010 fourth connecting flange; 101D fifth connecting flange; 101E sixth connecting flange; 102 metal cylindrical casing; 103 first water pipe; 104 plasma torch; 105 plasma power supply; 106 water cooling tank; 116 water cooling system; 107 insulation pad; 108 circulating water pump; 109 gas circulation pump; 110 treatment tank for waste gas and waste water; 111 circulating water pipe; 1111 water inlet end; 1112 water outlet end; 112 circulating water pipe inlet; 113 circulating water pipe outlet; 114 plasma heating section; 115 exhaust wasteheat heating section; 117 exhaust.

DETAILED DESCRIPTION

Figure 1:
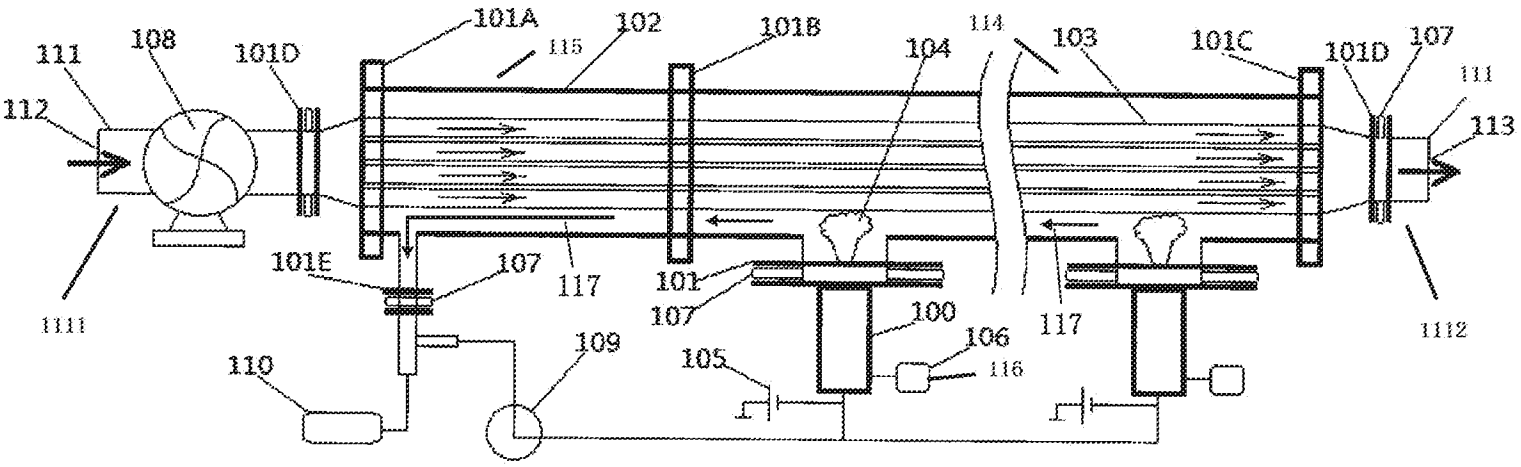
FIG. 1 is a structural front sectional view of a plasma heater in an embodiment of the present disclosure.
Figure 2:
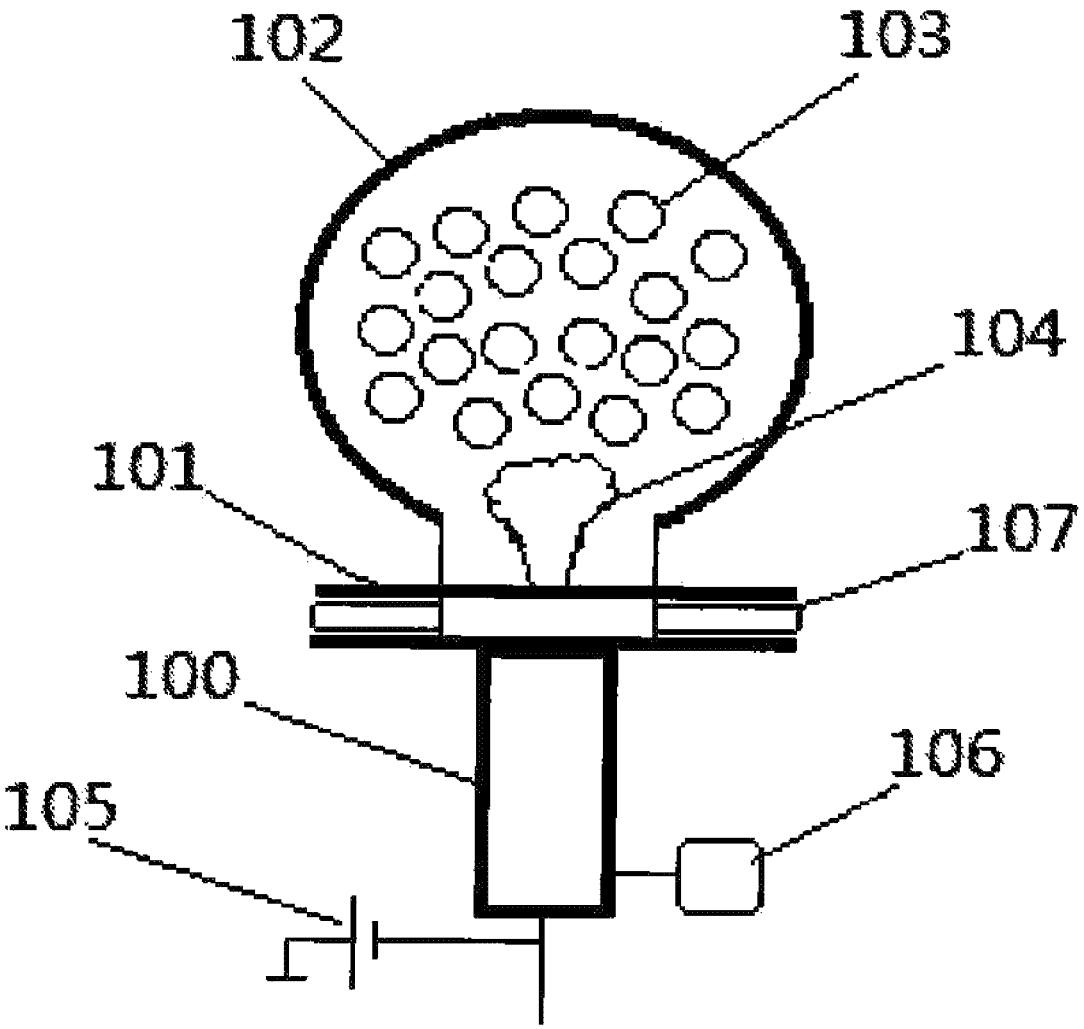
FIG. 2 is a structural tangential sectional view of a plasma heater in an embodiment of the present disclosure.

The detailed illustration of a plasma heater in a specific embodiment of the present disclosure is provided with reference to FIG. 1 and FIG. 2. The plasma heater comprises a plasma heating section 114 arranged between a third connecting flange 101B and a fourth connecting flange 101C. An exhaust wasteheat heating section 115 is arranged between a second connecting flange 101A and a third connecting flange 101B. The plasma heating section 114 and the exhaust wasteheat heating section 115 are intercommunicated. The plasma heating section 114 is provided with a plurality of first water pipes 103 coated by a metal cylindrical casing 102 of a first connecting flange 101. A plurality of plasma generators 100 are arranged in parallel below the first connecting flange 101 so that plasma torches 104 directly heat the first water pipes 103 in the metal cylindrical casing 102.

By referring to FIG. 1, the first water pipes 103 in the metal cylindrical casing 102 are the plurality of first water pipes 103 which are divided by the circulating water pipes 111 and are parallel to each other at certain clearances. The diameter of each first water pipe 103 is smaller than the diameter of each circulating water pipe 111. A circulating water pipe inlet 112 is provided in a water inlet end 1111 of the circulating water pipes 111, and a circulating water pipe outlet 113 is provided in a water outlet end 1112 of the circulating water pipes 111, a circulating water pump 108 is provided in the water inlet end 1111 of the circulating water pipes, and the circulating water pipes 111 are connected with the plasma heater through a fifth connecting flange 101D.

By referring to FIG. 1, the exhaust 117 of the plasma torches 104 generated by the plasma generators 100 flows through the exhaust wasteheat heating section 115 in the metal cylindrical casing 102 from the plasma heating section 114, then flows out of the metal cylindrical casing 102 to enter a sixth connecting flange 101E and then goes into an gas circulation pump 109 for exhaust and flows back into the plasma generators 100 through the gas circulation pump 109 for recycling.

By referring to FIG. 1 and FIG. 2, the plasma generators 100 are powered by a plasma power supply 105 of a DC power supply. And working gas of the plasma generators 100 is a mixture of air and vapor. Electrodes of the plasma generators 100 shall be cooled by a water cooling system 116 which is formed by connecting the water cooling tank 106, the matched water pipes, a water level sensor and the water pump.

The time interval between air change and discharge of the exhaust 117 of the plasma torches 104 is more than 10 minutes, and air change and discharge are completed within 1 minute. The tail gas discharges waste gas and waste liquid into the treatment tank 110 for waste gas and waste water through a valve for purification and recovering treatment.

An insulation pad 107 is arranged among the first connecting flange 101, the fifth connecting flange and the sixth connecting flange. The insulation pad 107 preferably adopts a high-temperature resistant asbestos pad, so that the metal cylindrical casing 102 and the heated first water pipes 103 become suspension electrodes.

The metal cylindrical casing 102, the first water pipes 103, the first connecting flange 101 and connecting pipes thereof are made of stainless steel materials.

What is claimed is:

1. A plasma heater, comprising a plasma heating section, an exhaust wasteheat heating section, a gas circulation pump, a water cooling system, a treatment tank for waste gas and waste water; and further comprising:

a plurality of circulating water pipes, wherein two of the plurality of circulating water pipes are communicated through a plurality of first water pipes; a diameter of each of the plurality of first water pipes is smaller than a diameter of each of the plurality of circulating water pipes;

a metal cylindrical casing, wherein the plurality of first water pipes is encased by the metal cylindrical casing;

a plurality of plasma generators, wherein the plurality of plasma generators are mutually communicated and are provided on a lateral inner wall of the metal cylindrical casing encasing the plurality of first water pipes; a flame emitted by a plasma torch of the plasma generator is directly applied, in a radial inward direction perpendicular to a flowing direction of water flowing in the plurality of first water pipes, to the first water pipes and perpendicular through a direction of flow of exhaust generated after combustion of the plasma torch for heating;

the exhaust wasteheat heating section comprises the metal cylindrical casing and the plurality of first water pipes; the plasma heating section comprises the metal cylindrical casing, the plurality of first water pipes and the plurality of plasma generators;

the water cooling system is connected to the plasma generators; and power is supplied to the plurality of plasma generators by a plasma power supplier;

the gas circulation pump is arranged on a water inlet end of the metal cylindrical casing and is communicated with the metal cylindrical casing and the treatment tank for waste gas and waste water; and exhaust generated after combustion of the plasma torch flows through the exhaust wasteheat heating section in the metal cylindrical casing, then flows out of the metal cylindrical casing and enters into the gas circulation pump, and flows back into the plasma generators through the gas circulation pump for recycling; and recycled exhaust works for more than 10 minutes before entering into the treatment tank for waste gas and waste water, wherein a first connecting flange is arranged between the plasma generators and the bottom of the metal cylindrical casing on the plasma heating section; an insulation pad is arranged on the first connecting flange; the metal cylindrical casing and the first water pipes act as suspension electrodes by way of the insulation pad.

2. The plasma heater of claim 1, wherein the plurality of first water pipes are parallel mutually and have clearances mutually; and a diameter of the first water pipes is between 20 mm and 60 mm.

3. The plasma heater of claim 2, wherein the plasma generator is a DC plasma torch with an upward nozzle; and a working gas of the plasma generators is a mixture of air and water vapor.

4. The plasma heater of claim 1, wherein the plasma generator is a DC plasma torch with an upward nozzle; and a working gas of the plasma generators is a mixture of air and water vapor.

5. The plasma heater of claim 1, wherein the water cooling system comprises a water cooling tank.

6. The plasma heater of claim 1, wherein a second connecting flange and a fourth connecting flange are arranged in the water inlet end and a water outlet end of the metal cylindrical casing, respectively; and a third connecting flange is arranged at a junction of the plasma heating section and the exhaust wasteheat heating section of the metal cylindrical casing.

7. The plasma heater of claim 1, wherein a circulating water pump is arranged in the water inlet end of the circulating water pipes.

8. The plasma heater of claim 1, wherein a fifth connecting flange is arranged in the water inlet and outlet ends of the circulating water pipes; and an insulation pad is arranged on the fifth connecting flange.

9. The plasma heater of claim 1, wherein a sixth connecting flange is arranged for exhaust emission between the metal cylindrical casing, the gas circulation pump and the treatment tank for waste gas and waste water.

10. The plasma heater of claim 1, wherein a circulating water pipe inlet is arranged in the water inlet end of the circulating water pipes and a circulating water pipe outlet is arranged in a water outlet end of the circulating water pipes.

* * * * *